US007404451B2

(12) United States Patent
Neumann

(10) Patent No.: US 7,404,451 B2
(45) Date of Patent: Jul. 29, 2008

(54) WOBBLE DEVICE FOR A HAND-HELD POWER TOOL AND A HAND-HELD POWER TOOL WITH THE WOBBLE DEVICE

(75) Inventor: Jens Neumann, Shanghai (CN)

(73) Assignee: Hilti Aktiengesellschaft, Schaan (LI)

( * ) Notice: Subject to any disclaimer, the term of this patent is extended or adjusted under 35 U.S.C. 154(b) by 190 days.

(21) Appl. No.: 11/410,804

(22) Filed: Apr. 24, 2006

(65) Prior Publication Data

US 2006/0266139 A1 Nov. 30, 2006

(30) Foreign Application Priority Data

Apr. 25, 2005 (DE) ..... 10 2005 019 196

(51) Int. Cl.
*B25D 11/10* (2006.01)

(52) U.S. Cl. ..... 173/109; 173/201

(58) Field of Classification Search ..... 173/48, 173/109, 104, 201, 114
See application file for complete search history.

(56) References Cited

U.S. PATENT DOCUMENTS 1,812,934 A * 7/1931 Curtis ..... 464/134
4,371,357 A * 2/1983 Petrzelka et al. ..... 464/128
4,446,931 A 5/1984 Blecher et al.
4,537,264 A * 8/1985 Schmid et al. ..... 173/48
4,732,217 A * 3/1988 Bleicher et al. ..... 173/104
5,036,925 A 8/1991 Wache
6,971,455 B2 * 12/2005 Shibata et al. ..... 173/48
7,287,600 B2 * 10/2007 Braun ..... 173/48
2004/0112614 A1 6/2004 Buchholz

FOREIGN PATENT DOCUMENTS

DE 3307521 9/1984
DE 3427342 1/1986
EP 0152645 8/1985

OTHER PUBLICATIONS

European Search Report.

* cited by examiner

*Primary Examiner*—Scott A. Smith
(74) *Attorney, Agent, or Firm*—Abelman, Frayne & Schwab

(57) ABSTRACT

A wobble device (20) for a hand-held power tool (2) and which includes a rotatable drive member (22), a driven member (26) oscillatingly pivotable about a wobble axis (T) and a wobble bearing (30) for connecting the driven member (26) with the drive member (22) and having a drive-side bearing region with a drive-side guide (34) circumferentially arranged about the drive axis (A) and provided on the drive member (22), a driven-side bearing region with a driven-side guide (38) circumferentially arranged about the drive axis (A) and provided on the driven member (26) and roll elements (28) guided simultaneously in both guides (34, 38), and with one of the bearing regions having on its first side (46, 48; 50, 52) with respect to an associated guide (34; 38), a reinforced cross-section in comparison with a second side (48, 46; 52, 50) of the one region.

4 Claims, 3 Drawing Sheets

WOBBLE DEVICE FOR A HAND-HELD POWER TOOL AND A HAND-HELD POWER TOOL WITH THE WOBBLE DEVICE

BACKGROUND OF THE INVENTION

1. Field of the Invention

The present invention relates to a wobble device for a hand-held power tool including a drive member rotatable about a drive axis, a driven member oscillatingly pivotable about a wobble axis, and a wobble bearing for connecting the driven member with the drive member. The wobble bearing has a drive-side bearing region with a drive-side guide circumferentially arranged about a drive axis and provided on the drive member, and a driven-side bearing region with a driven-side guide circumferentially arranged about the drive axis and provided on the driven member. The wobble bearing further includes roll elements guided simultaneously in both guides.

2. Description of the Prior Art

The wobble devices of the type discussed above are often used in hammer drills for converting a rotational movement of a spindle drive in a reciprocating linear movement of a driving piston. The driving piston drives a striker that applies a pulsed impact energy to a working tool holder.

German Publication DE 34 27 342 A1 discloses a hammer drill with a wobble drive for driving an air-cushion percussion mechanism. The wobble drive has drum press-fit on an intermediate shaft and having a spherical outer surface in which a circumferential groove is formed. The wobble drive further includes an annular wobble plate on the inner side of which an outer circumferential groove is formed. A ball is provided between the two grooves, which is simultaneously guided in both grooves.

The wobble drive described above is subjected, during operation, to a relatively high load, in particular, to pulsed reaction forces which are generated during operation of the percussion mechanism. On the other hand, the bearing region should be dimensioned so that mounting of the drive member, the driven member, and of the roll elements, which are arranged therebetween, is possible. Therefore, breaking of material, in particular, in the region of the guide can take place. The breaking of material noticeably reduces the service life of the wobble drive.

Accordingly, an object of the invention is a wobble drive having an increased service life.

Another object of the invention is a wobble drive in which its high stability is insured.

SUMMARY OF THE INVENTION

These and other objects of the present invention, which will become apparent hereinafter, are achieved, according to the invention, by providing a wobble device in which the wobble bearing has, in one of the bearing regions, on a first side of the one bearing region, with respect to an associated guide, a reinforced cross-section in comparison with a second side of the one bearing region.

The reinforcement of the cross-section can be produced, e.g., by reinforcing the material or by increasing the cross-section with respect to the base shape of the corresponding bearing region. In this way, the strength of the wobble bearing in the axial direction with respect to the drive axis, in which, during an operation, particularly high material stresses are generated, is noticeably increased. The mounting of the wobble device can be effected over the other, less strong side of the corresponding bearing region.

According to a particularly advantageous embodiment of the present invention, the reinforced cross-section is produced by circumferentially increasing the cross-section of the first side of the one bearing region with respect to the guide in comparison with the base shape of the bearing region on the second side. At, e.g., cylindrical or spherical base shape of the bearing region, the reinforced cross-section is achieved by changing the diameter of the bearing region on the first side in comparison with the diameter on the second side of the bearing region. Thereby by increasing the cross-section of the material, a high break resistance is achieved, which insures a disturbance-free operation of the wobble drive over the service life of the power tool. On the second side of the guide, the cross-section of the bearing region is selected to insure a problem-free mounting of the drive and driven members and the arrangement of roll elements therebetween.

Advantageously, in the driven-side bearing region, the reinforced cross-section is produced by decreasing an inner diameter of the first side of the driven-side bearing region on the driven-side guide relative to the second side of the driven-side bearing region. Thereby, the stability of the driven-side bearing region on the first side relative to the guide is increased, while the mounting can be carried out over the second side problem-free.

Advantageously, both the first and second sides have a cylindrical shape. Thereby, different inner diameters of the driven-side bearing region can be produced in a particularly simple way by drilling with different diameters.

Advantageously, in the drive-side bearing region, the reinforced cross-section is produced by increasing an outer diameter of the first side of the drive-side bearing region on the drive-side guide relative to the second side of the drive-side bearing region Thereby, the stability of the drive-side bearing region on the first side on the drive-side guide is increased, while the mounting can be carried out without any problems over the second side of the drive-side bearing region.

Advantageously, both the first and second sides of the drive-side bearing region have a spherical shape. This provides a maximal cross-sectional surface over the entire drive-side bearing region, whereby a maximal stability becomes possible.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
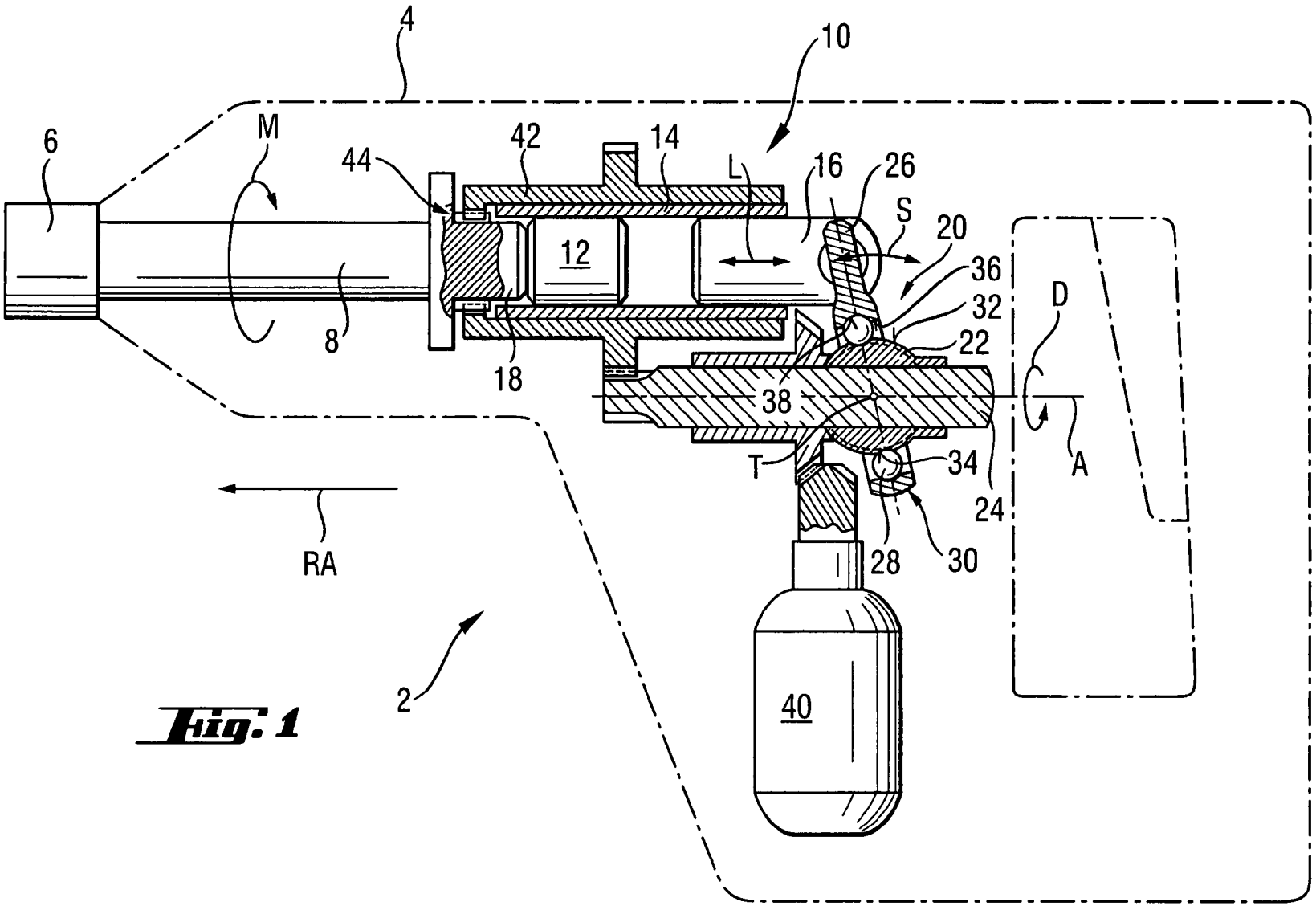
FIG. 1 a partially cross-sectional side view of a hand-held tool with a wobble device according to the present invention.

FIG. 1 shows a hand-held power tool 2 having a housing 4, which is shown schematically, and a chuck 6 provided at an end of the housing 4 extending in the operational direction RA. The chuck 6 is held on a power tool spindle 8. A percussion mechanism 10 applies a pulsed reciprocating impact force to the power tool spindle 8. To this end, the percussion mechanism 10 has a striker 12 displaceable in a guide sleeve 14 by a driving piston 16 that applies a reciprocation movement to the striker 12. The striker 12 applies, during its recurrent movement, blows to the rear end of the power tool spindle 8 that functions as an anvil 18.

For reciprocatingly driving the driving piston 16, the hammer drill percussion mechanism 10 includes a wobble device 20. The wobble device 20 includes essentially a drive member 22 in form of a wobble drum press-fit on an intermediate shaft 24, and a driven member 26 in form of a wobble plate connected with the driving piston 16 and performing an oscillating pivotal movement S about a wobble axis T during operation of the power tool 2. The driven member 26 is connected with the drive member 22 by spherical roll elements 28 of a wobble bearing 30.

The outer surface 32 of the drive member 22 has a spherical base shape and functions as a drive-side baring region in which a drive-side guide 34 for the roll element 28 is circumferentially arranged. The drive-side guide 34 is inclined relative to drive axis A of the intermediate shaft 24 or the drive member 22. The driven member 26 has an inner wall 36 that serves a driven-side bearing region and has a cylindrical base shape. The inner wall 36 is provided in the middle of the driven-side guide 38 for the roll element 28. The inner wall 36 limits the receiving space in which the drive member 22 is arranged.

When the intermediate shaft 24 is driven by a motor 40, the wobble bearing 30 converts the rotational movement D of the drive member 22 in the oscillating pivotal movement S about the wobble axis T and, due to the connection with the driving piston 16, in a linear reciprocating movement L.

Simultaneously, the intermediate shaft 24 rotates the gear sleeve 42 about the guide sleeve 14. The toothing 44 transmits the rotation of the gear sleeve 42 to the tool spindle 8. As a result, in addition to an impact pulse, simultaneously, a torque M is applied to the tool spindle 8, and the setting tool 2 become ready for effecting a percussion drilling.

As particularly shown in FIGS. 2-5, there are provided different embodiments of the wobble device 20 in which the stability of respective wobble bearing 30 is increased by a one-sided increase of the cross-section of the base shape of a respective baring region.

Figure 2:
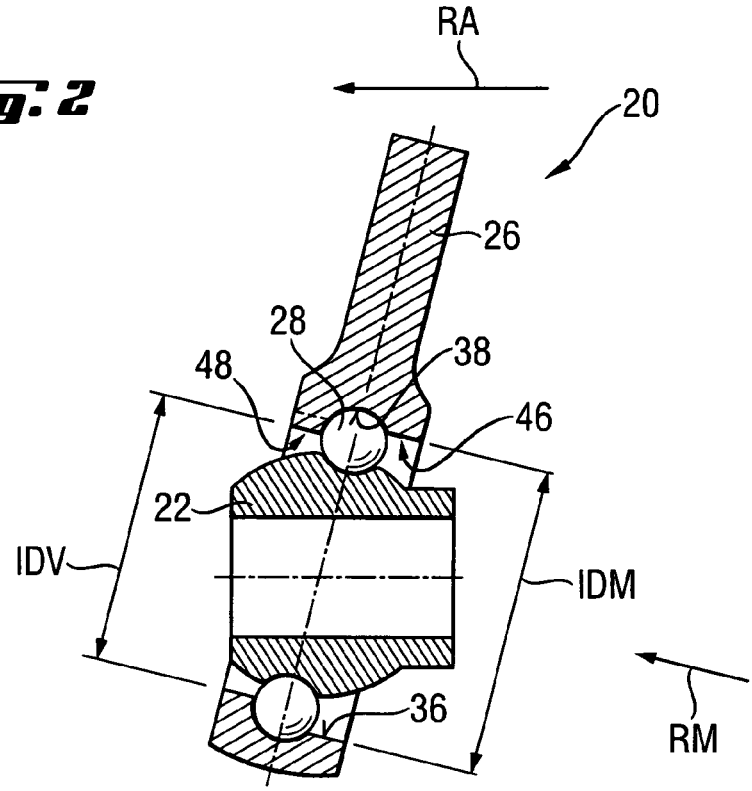
FIG. 2 a cross-sectional view of a first embodiment of the wobble device with a reduced inner diameter of a drive-side bearing region on a side of the bearing region extending in an operational direction.

FIG. 2 shows an embodiment of the wobble device 20 in which an inner diameter IDM of the inner wall 36 necessary for mounting of the driven member 26 on the drive member 22 by means of intermediate arrangement of roll elements 28, is provided on a side 46 of the driven-side guide 38 remote with respect to the operational direction RA. Thereby, mounting of the wobble device 20 is effected by relative displacement of the drive member 22 relative to the driven member 26 along the mounting direction RM.

On the side 48 of the driven-side bearing region, which is located, with respect to the driven-side guide 38, in the operational direction RA, the cylindrical inner wall has an inner diameter IDV reduced in comparison with the necessary inner diameter IDM, which increases the cross-section of the driven-side bearing region. In this way, the break resistance of the driven-side bearing region on the side 48 extending in the operational direction RA is increased.

Figure 3:
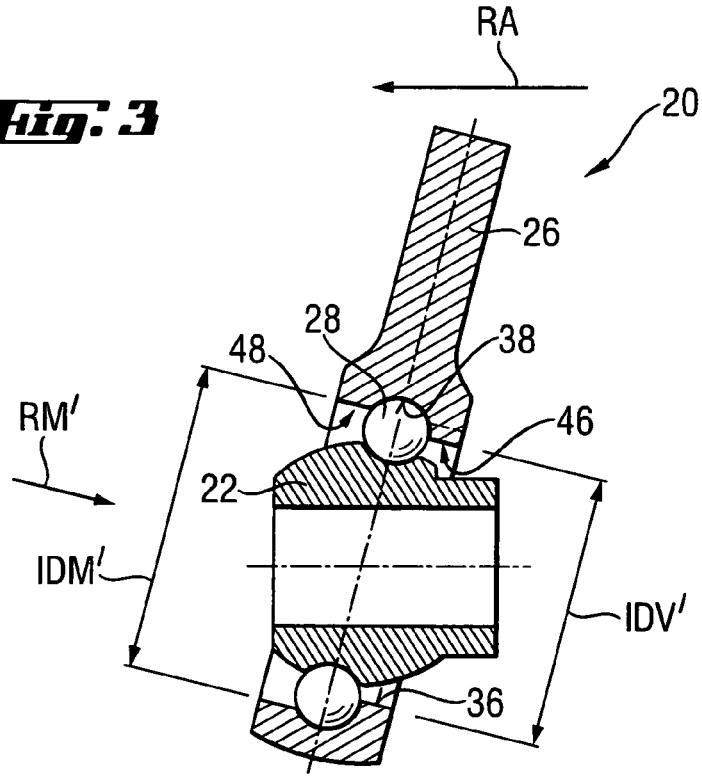
FIG. 3 a cross-sectional view of a second embodiment of the wobble device with a reduced inner diameter of a driven-side bearing region on a side of the bearing region extending in a direction opposite the operational direction.

FIG. 3 shows an embodiment of the wobble device 20 in which an inner diameter $IDM^1$ of the inner wall 36 necessary for mounting of the driven member 26 on the drive member 22 by means of intermediate arrangement of roll elements 28, is provided on a side 48 of the driven-side guide 38 which extends in the operational direction RA. Thereby, mounting of the wobble device 20 is effected by relative displacement of the drive member 22 relative to the driven member 26 along the mounting direction $RM^1$.

On the side 46 of the driven-side bearing region extending with respect to the driven-side guide 38, in the direction opposite operational direction RA, the cylindrical inner wall 36 has an inner diameter $IDV^1$ reduced in comparison with the necessary inner diameter IDM, which increases the cross-section of the driven-side bearing region. In this way, the break resistance of the driven-side of the bearing region on the side 46 extending in a direction opposite the operational direction RA is increased.

Thus, dependent on how the hand-held power tool is formed, the embodiment of the wobble device 20 according to FIG. 2 or FIG. 3 can be used in order to reinforce the side of the driven-side bearing region, so that it can withstand larger loads. The other side is used for mounting of the wobble device. The cylindrical base shape of the inner wall 36 is retained on both sides 46, 48 of the driven-side bearing region.

Figure 4:
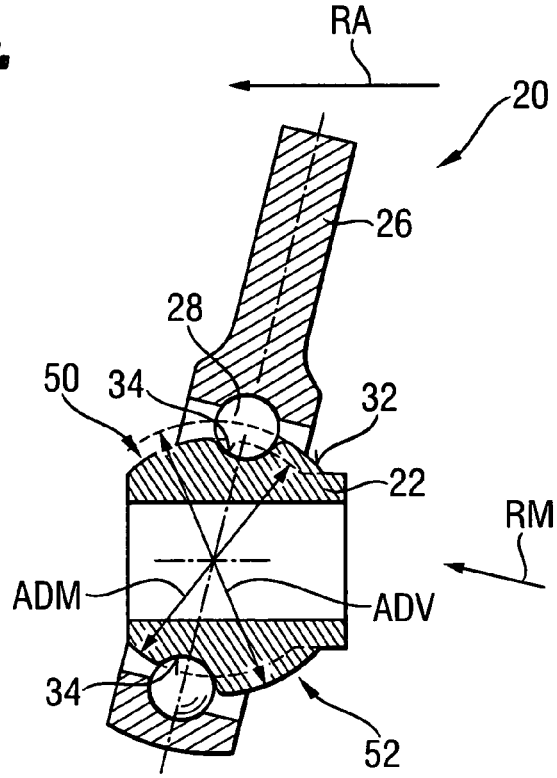
FIG. 4 a cross-sectional view of a third embodiment of the wobble device with an increased outer diameter of a drive-side bearing region on a side of the bearing region extending in a direction opposite the operational direction.

FIG. 4 shows an embodiment of the wobble device 20 in which a maximum possible outer diameter ADM of the surface 32 of the drive-side bearing region necessary for mounting of the driven member 26 on the drive member 22 by means of intermediate arrangement of roll elements 28, is provided on a side 50 of the drive-side guide 34 and which extends in the operational direction RA. Thereby, mounting of the wobble device 20 is effected by relative displacement of the drive member 22 relative to the driven member 26 along the mounting direction RM.

On the side 52 of the drive-side bearing region, which is located on to the drive-side guide 34, the surface 32 has an increased outer diameter which increases the cross-section of the drive-side bearing region. In this way, the break resistance of the drive-side bearing region on the side 52 extending in a direction opposite the operational direction RA is increased.

Figure 5:
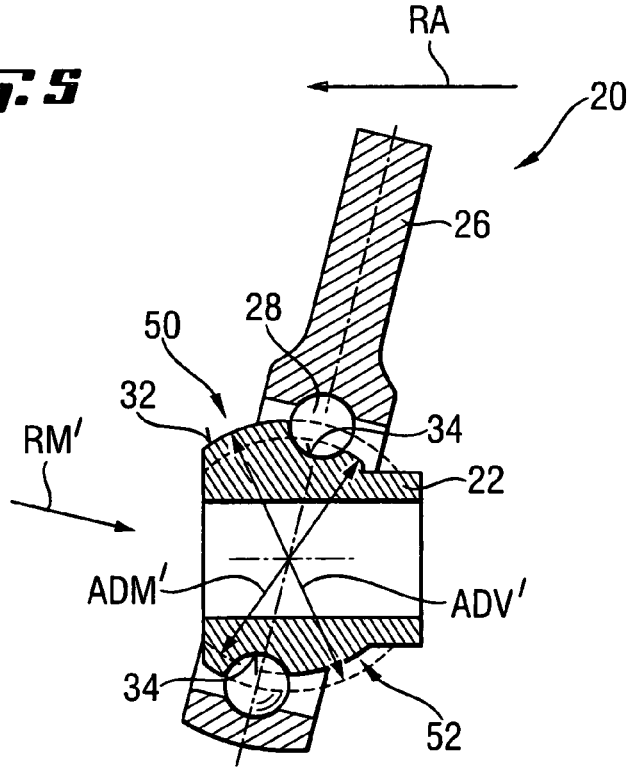
FIG. 5 a cross-sectional view of a fourth embodiment of the wobble device with an increased outer diameter of a drive-side bearing region on a side of the bearing region extending in an operational direction.

FIG. 5 shows an embodiment of the wobble device 20 in which maximum possible outer diameter $ADM^1$ of the surface 32 necessary for mounting of the driven member 26 on the drive member 22 by means of intermediate arrangement of roll elements 28, is provided on a side 52 of the drive-side bearing region extending, with respect to the drive-side guide 34 in the operational direction RA. Thereby, mounting of the wobble device 20 is effected by relative displacement of the drive member 22 relative to the driven member 26 along the mounting direction $RM^1$.

On the side 50 of the drive-side guide 34 and, which extends in the operational direction RA, the surface 32 has an increased diameter $ADV^1$ increased with respect to the outer diameter $ADM^1$, which increases the cross-section of the drive-side bearing region. In this way, the break resistance of the drive-side bearing region on the side 50 extending in the operational direction RA is increased.

Thus, dependent on how the power tool is formed, the embodiment of the wobble device according to FIG. 4 or FIG.

5 can be used in order to reinforce the side 50 or 52 of the drive-side bearing region, which is subjected to greatest loads. The respective other side is used for mounting of the wobble device 20. the spherical shape of the surface 32 is retained on both sides 50, 52 of the drive-side bearing region.

It is also possible to provide on the equal, with respect to the operational direction RA, sides 48, 50 and 46, 52 of the drive-side and driven-side bearing regions, respectively, simultaneously a reduced inner diameter IDV, $IDV^1$ and an increased outer diameter ADV, $ADV^1$, and to provide, on other sides 46, 52; 48, 50 of the bearing regions the necessary for mounting, inner diameter IDM, $IDM^1$ and outer diameter ADM, $ADM^1$.

Though the present invention was shown and described with references to the preferred embodiments, such are merely illustrative of the present invention and are not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A hand-held power tool, comprising:

a spindle (8); and a wobble device (20) for imparting a reciprocating movement to the spindle (8), the wobble device including:

a drive member (22) rotatable about a drive axis (A);

a driven member (26) oscillatingly pivotable about a wobble axis (T) and connectable with the spindle (8); and a wobble bearing (30) for connecting the driven member (26) with the drive member (22), wherein the wobble bearing (30) has a drive-side bearing region with a drive-side guide (34) circumferentially arranged about the drive axis (A) and provided on the drive member (22), a driven-side bearing region with a driven-side guide (38) circumferentially arranged about the drive axis (A) and provided on the driven member (26); and roll elements (28) guided simultaneously in both guides (34, 38), and wherein the wobble bearing (30) has, in one of the bearing regions, on a first side (46, 48; 50, 52) of the one region, with respect to an associated guide (34; 38), a reinforced cross-section in comparison with a second side (48, 46; 52, 50) of the one region, and wherein the one bearing region is the driven-side bearing region, and wherein the reinforced cross-section is produced-by decreasing an inner diameter (IDV: IDV1) of the first side (48; 46) of the driven-side bearing region on the driven-side guide (38) relative to the second side (46, 48) of the driven-side bearing region.

2. A wobble device (20) for a hand-held power tool (2), comprising:

a drive member (22) rotatable about a drive axis (A);

a driven member (26) oscillatingly pivotable about a wobble axis (T); and a wobble bearing (30) for connecting the driven member (26) with the drive member (22), wherein the wobble bearing (30) has a drive-side bearing region with a drive-side guide (34) circumferentially arranged about the drive axis (A) and provided on the drive member (22), a driven-side bearing region with a driven-side guide (38) circumferentially arranged about the drive axis (A) and provided on the driven member (26); and roll elements (28) guided simultaneously in both guides (34, 38), and wherein the wobble bearing (30) has, in one of the bearing regions, on a first side (46, 48; 50, 52) of the one bearing region, with respect to an associated guide (34; 38), a reinforced cross-section in comparison with a second side (48, 46; 52, 50) of the one bearing region; and wherein the one bearing region is the driven-side bearing region, and wherein the reinforced cross-section is produced-by decreasing an inner diameter (IDV; $IDV^1$) of the first side (48; 46) of the driven-side bearing region on the driven-side guide (38) relative to the second side (46, 48) of the driven-side bearing region.

3. A wobble device according to claim 2, wherein both the first side (48; 46) and the second side (46; 48) of the driven-side bearing region have a cylindrical shape.

4. A wobble device (20) for a hand-held power tool (2), comprising:

a drive member (22) rotatable about a drive axis (A);

a driven member (26) oscillatingly pivotable about a wobble axis (T); and a wobble bearing (30) for connecting the driven member (26) with the drive member (22), wherein the wobble bearing (30) has a drive-side bearing region with a drive-side guide (34) circumferentially arranged about the drive axis (A) and provided on the drive member (22), a driven-side bearing region with a driven-side guide (38) circumferentially arranged about the drive axis (A) and provided on the driven member (26); and roll elements (28) guided simultaneously in both guides (34, 38), and wherein the wobble bearing (30) has, in one of the bearing regions, on a first side (46, 48; 50, 52) of the one bearing region, with respect to an associated guide (34; 38), a reinforced cross-section in comparison with a second side (48, 46; 52, 50) of the one bearing region, wherein the one region is the drive-side bearing region, and wherein the reinforced cross-section is produced by increasing an outer diameter (ADV;

$ADV^1$) of the first side (52; 50) of the drive-side bearing region on the drive-side guide (34) relative to the second side (50, 52) of the drive-side bearing region, and wherein both the first side (52; 50) and the second side (50; 52) of the drive-side bearing region have a spherical shape.

* * * * *